US010844620B2

(12) United States Patent
Stock

(10) Patent No.: US 10,844,620 B2
(45) Date of Patent: Nov. 24, 2020

(54) OVERFLOW POOL WITH MOVABLE BOTTOM

(71) Applicant: TECHNO-POOL, Roubaix (FR)

(72) Inventor: Michel Stock, Auchy-lez-Orchies (FR)

(73) Assignee: TECHNO-POOL, Roubaix (FR)

( * ) Notice: Subject to any disclaimer, the term of this patent is extended or adjusted under 35 U.S.C. 154(b) by 0 days.

(21) Appl. No.: 16/349,712

(22) PCT Filed: Nov. 14, 2017

(86) PCT No.: PCT/FR2017/053105
§ 371 (c)(1),
(2) Date: May 14, 2019

(87) PCT Pub. No.: WO2018/087498
PCT Pub. Date: May 17, 2018

(65) Prior Publication Data

US 2019/0316373 A1 Oct. 17, 2019

(30) Foreign Application Priority Data

Nov. 14, 2016 (FR) ..... 16 60971

(51) Int. Cl.
*E04H 4/12* (2006.01)
*E04H 4/06* (2006.01)

(52) U.S. Cl.
CPC ..... *E04H 4/1227* (2013.01); *E04H 4/065* (2013.01)

(58) Field of Classification Search
CPC ..... E04H 4/1227
USPC ..... 4/495; 482/55
See application file for complete search history.

(56) References Cited

FOREIGN PATENT DOCUMENTS

| | | | |
|---|---|---|---|
| FR | 1350562 | A | 1/1964 |
| FR | 3001246 | A1 | 7/2014 |
| WO | 2011/030043 | A1 | 3/2011 |
| WO | 2011/077377 | A2 | 6/2011 |

OTHER PUBLICATIONS

International Search Report dated Feb. 26, 2018 in corresponding International Application No. PCT/FR2017/053105; 4 pages.

*Primary Examiner* — Lori L Baker
(74) *Attorney, Agent, or Firm* — Maier & Maier, PLLC

(57) ABSTRACT

A swimming pool including a movable bottom, side walls and a movable platform defining the bathing volume. The platform, actuated by a system, passes from a submerged position to a raised position in the air to close the bathing volume. A peripheral flow conduit, arranged at the periphery of the bathing volume and the side walls, has an upper mouth system and a lower mouth system communicating with the bathing volume. The pool has a main water tank containing water from the overflow, a secondary tank for collecting the overflow, a pump system linking buffer tanks and continuously supplying the overflow, and a water collection system. The water collection system extends the periphery of the bathing volume and passes from a low position when the platform is static to a high position when the platform moves, providing a peripheral anti-overflow barrier and constituting the upper mouth system.

15 Claims, 10 Drawing Sheets

OVERFLOW POOL WITH MOVABLE BOTTOM

FIELD OF INVENTION

The present invention concerns the field of pools, either installed above ground or buried, in particular pools with a movable bottom. The invention more particularly concerns an overflow pool with a movable bottom.

BACKGROUND

There are firstly known from the prior art overflow pools that are appreciated for their aesthetic and that are characterized by one or more sides of the pool overflowing because of the action of a pump system: in this kind of pool the water level is therefore substantially constant regardless of the bathing conditions (such as the number of bathers, the overflowing water volume) or external conditions such as bad weather.

Compared to a non-overflow pool, this kind of pool therefore necessitates a water recirculation circuit that comprises one or more secondary tanks (distinct from the overflowing bathing volume). The function of this secondary tank or these secondary tanks is to collect the overflowing water and to serve as a buffer if the volume of water in the pool varies, for example because of the presence of bathers in the bathing volume of the overflow pool, or again because of an addition of water such as rainwater. The recirculation circuit provides a water flow rate that maintains constant the water level of the continuously overflowing pool.

The inventor has observed that this kind of overflow pool therefore has a first disadvantage of necessitating a large construction space, not only because of the main construction, i.e. the tank defining the overflow bathing volume, but also because of the secondary tanks with the buffer function that occupy a space additional to that construction.

Because of the continuous overflowing of the pool, which favors thermal exchanges and evaporation, overflow pools also have the major disadvantage of cooling the water from the pool, which very often necessitates the addition of a heating system, for example using a heat pump, and increases the operating costs.

There are also known pools with a movable bottom, for example in order to improve the safety of young children by enabling adjustment of the depth of the pool. The mobile platform also makes it possible, when the pool is not being used, to be able to use the surface of the platform as a floor.

Thus there exist in the prior art different types of movable bottom for pools enabling the depth of the pool to be varied or even to use the mobile bottom as a plane floor surface.

The movable bottom generally takes the form of a platform able to move from an immersed bottom position in which the mobile bottom constitutes the bottom of the pool to a top position in the open air in which the mobile bottom forms a floor.

A pool with a movable bottom of this kind is known from the document WO 2011/077377. According to a first embodiment from that document, shown in FIG. 2, the platform comprises a plate intended to be walked on and an onboard ballast intended to be filled with water or with air according to the position to be imparted to the mobile bottom. By changing the buoyancy of the platform it is possible to actuate the platform to lower it or to raise it.

Other embodiments of the platform are known from other prior art, such as cylinders for example, or pulley and cable systems.

By virtue of the action of the platform, water is moved on either side of said platform, downward during raising or upward during lowering. Because of the impermeability of the platform, it is necessary to leave a large gap between the peripheral edge of the mobile platform and the side walls in order to allow this circulation of water. The main disadvantage of this embodiment is to leave a relatively large gap between the peripheral edge of the platform and the side walls, which is not acceptable in terms of safety because of the risks of pinching.

There also exists a risk of introduction of dirt and/or objects via the gaps present between the walls of the pool and the platform, the objects then being difficult to recover.

This gap is also undesirable when the platform is in the top position, above the surface of the water, in that the platform does not enable optimum insulation of the pool from the outside environment, heat escaping via this gap.

According to a second embodiment from the document WO 2011/077377, shown in FIG. 8 of the document, the platform is permeable, in particular perforated, so as to allow water to pass through the platform during raising and lowering.

However, this kind of embodiment does not enable thermal insulation of the pool, or even the formation of a screen against evaporation, when the platform is in the top position. One consequence of this is to increase the energy consumption for heating and, where applicable, the energy for dehumidifying the environment of the building in which the pool is situated.

There is also known from the present applicant's document FR 1350562 a pool with a movable bottom that comprises a peripheral water circulation duct outside the bathing volume. That peripheral circuit comprises an upper mouth and a lower mouth communicating with the bathing volume.

During rising movements of the platform this circuit allows circulation of water from above to below the platform, the water entering the circuit via the upper mouth, exiting via the lower mouth, by virtue of the propulsion action of the platform. Conversely, during descending movements, the circuit allows circulation of water from under to over the platform, water entering via the lower mouth into the circuit, exiting via the upper mouth, by virtue of the propulsion action of the platform.

This kind of circuit advantageously enables use of a platform with impermeable walls, which in particular makes it possible to obtain good thermal insulation performance when the platform is in the top position, above the water, whilst limiting the size of the peripheral clearance between the platform and the side walls of the bathing volume, which is the source of a risk of pinching.

In this kind of pool design, in the top position the movable platform advantageously comes to extend the surface of the floor around the pool, producing a perfectly flat floor, advantageously with no discontinuity between the surface of the movable platform then in the top position and the surface of the floor at the periphery of the pool.

The inventor has observed that a movable bottom platform pool conforming to the design from the document FR 1350562 is nevertheless not compatible with an overflow pool design.

According to tests carried out by the inventor, in a pool such as that described in the document FR 1350562 a slight increase in the water surface level is found for example during raising or lowering movements of the platform.

SUMMARY

The objective of the present invention is to alleviate the aforementioned disadvantages by proposing an overflow pool with a movable bottom that, on the one hand, makes it possible to achieve a successful aesthetic thanks to an overflow water level substantially at the height of the floor around the pool, and, on the other hand, achieves good thermal insulation performance in the closing position of the platform, which is then substantially at the level of the floor, and further enables a plane surface to be obtained formed by the movable platform then in the raised position and the floor at the periphery of the pool, advantageously with no intermediate discontinuity present.

Another objective of the present invention is to propose a pool of this kind that minimizes the construction space necessary for the production of an overflow pool compared to the known prior art.

Another objective of the present invention is to propose a pool drastically limiting heat losses when not in use.

Other objectives and advantages of the invention will become apparent in the course of the following description that is given by way of illustration only.

Also the invention concerns a pool with movable bottom and comprising:

- side walls and a mobile platform defining between them the bathing volume of the pool, the platform being able to pass from at least one immersed bottom position to a raised position in the open air, closing the bathing volume,
- a system for actuating said mobile platform to raise it or to lower it,
- a peripheral circulation duct disposed at the periphery of the bathing volume and of said side walls, said circulation duct including an upper mouth system and a lower mouth system communicating with the bathing volume so as to allow, through the action of the mobile platform, water to circulate through said circulation duct, on either side of the mobile platform, from the upper mouth system to the lower mouth system during the ascent of said mobile platform, and from the lower mouth system to the upper mouth system during the descent of said mobile platform.

According to the invention, said pool is an overflow pool comprising:

- a main water tank containing the overflowing water from the bathing volume, receiving said side walls, the circulation duct and the mobile platform,
- one or more secondary tanks for collecting overflowing water, with a buffer function, termed buffer tanks,
- a pump system connecting the buffer tanks and continuously feeding the overflowing bathing volume with water from the buffer tanks, and in which said pool comprises a water collector system extending at the periphery of the bathing volume and adapted to collect overflowing waters at the periphery of the bathing volume, and in which said overflowing water collector system is mobile, at least in part, being able to pass:

- from a bottom position in which the water collector system, on the one hand, constitutes an overflow defining the height of the overflow, receiving water when the pool functions in overflow mode, the then static mobile platform in an immersed bottom position, in a first state of said collector system allowing the collected water to flow to the buffer tank or tanks, and, on the other hand, constitutes a walking surface substantially at the level of the mobile platform then in the raised position closing the bathing volume, in particular in a second state of said collector system,
- to a top position, situated above the level of the raised closing position of the mobile platform, in which top position the water collector system constitutes an anti-overflow peripheral barrier during rising and descending movements of the mobile platform, in a third state of said collector system, and then constitutes the upper mouth system of the circulation circuit through which water enters during raising of the mobile platform or water exits during lowering of the mobile platform.

According to optional features of the invention, considered separately or in combination:

- said water circulation duct is a peripheral duct defined by the interior space of a double wall formed between a watertight exterior envelope of the pool defining the main water tank and said side walls internal to the watertight exterior envelope, said side walls being immersed to their full height at least during operation in overflow mode;
- the water collector system is situated outside the double wall forming the circulation duct, the pool having a peripheral curb covering the interior space of the double wall, said curb being intended to be walked on, and in which the upper surface of the curb is situated at the height of the walking surface of the water collector system in said bottom position of said collector system and so that the walking surfaces respectively belonging to the mobile platform in the raised closing position of the mobile platform, to the curb and to the collector system are extended with no discontinuity in level,
- said curb is configured so that water overflowing from the bathing volume flows over the curb to the collector system during functioning of the pool in overflow mode or again during rising movements of the mobile platform;
- the buffer tanks are received at the periphery, outside the double wall forming the circulation duct, received in a hollow structure, the water collector system being situated vertically above the hollow structure, positioned laterally with respect to the circulation duct;
- the hollow structure, extending all around the periphery of the double wall forming the circulation duct, said structure forming a plurality of vertical box sections, distributed along said periphery, said buffer tanks respectively received in said vertical box sections;
- a thermal insulation such as synthetic foam fills the voids of the hollow structure and insulates each buffer tank on the outside, the received insulation filling the interior space between the buffer tank and the interior walls of the box section;
- a sealing system provides the watertight closure between the mobile platform and the curb in said raised closing position of the mobile platform.

According to one embodiment, the overflowing water collector system comprises:

- a U-section water receiving gutter comprising a bottom wall and two projecting side walls extending on respective opposite sides of the bottom wall, defining an upper opening of the water receiving gutter, the interior side wall situated on the same side as the bathing volume including first, in particular lateral openings in communication with the circulation duct and second, in particular bottom openings in communication with the buffer tanks, a substantially horizontal grille covering the upper opening of the water receiving gutter and the upper surface of which constitutes the walking surface, a blocking and branch member inside the gutter and mobile relative to the gutter, being able to assume three positions:

a top first position in which the blocking and branch member blocks the grille in the bottom position of the water collector system then in said second state in which the mobile platform is in the raised position closing the pool, a second position lower than the first position in which the blocking and branch member frees the openings of the grille, in the bottom position of the water collector system in which the mobile platform is static, in the immersed bottom position, allowing overflowing water to pass through the grille and drop into the water receiving gutter, the blocking and branch member blocking the first, in particular lateral openings of the gutter, the water collected in the gutter being evacuated via the second openings to the buffer tanks, a third position higher than the first and second positions in which the blocking and branch member picks up and supports the grille above the level of the raised closing position of the platform, freeing the first openings of the water receiving gutter, constituting the top position of the water collector system, the blocking and branch member constituting in this top position said anti-overflow peripheral barrier, the water propelled by the movements of the platform flowing through said circulation duct, through the first openings of the water receiving gutter.

According to one embodiment, a blocking system inside the gutter closing the second opening when the collector system is in the top position and so that water flows through the first openings, said blocking system opening the second openings in the first state of the collector system when the collector system is in the bottom position and so that the overflowing water collected in the gutter is directed to the buffer tanks.

According to one embodiment, the system for actuating the platform comprises a plurality of actuators received in the double wall forming the circulation duct, each actuator comprising:

a substantially vertical motorized lead screw received in the double wall, a nut fastened to a support projecting laterally from the mobile platform and cooperating with the lead screw.

According to one embodiment, the overflowing water collector system comprises:

a U-section water receiving gutter comprising a bottom wall and two side walls extending on respective opposite sides of the bottom wall, the interior side wall situated on the same side as the bathing volume including first, in particular lateral openings in communication with the circulation duct and second, in particular bottom openings in communication with the buffer tanks, a static part covering the gutter and forming a walking surface substantially at the level of the mobile platform then in the raised position closing the bathing volume, said static part defining said bottom position of said collector system, an interior space separating said static part from the curb forming an upper opening for the gutter, a mobile part inside the gutter and mobile relative to the gutter and to said static part being able to assume three positions:

a blocking first position in which said mobile part blocks the interior space between the curb and said static part, the water collector system then in said second state for which the mobile platform is in the raised position closing the pool, the upper surface of the mobile part extending the walking surface of said static part, a second position lower than the first position in which the mobile part opens the water receiving gutter, allowing overflowing water to drop into the water receiving gutter, in said bottom position of the water collection system then in the first state in which the mobile platform is static, in the immersed bottom position, the mobile part blocking the first, notably lateral openings of the gutter, water collected in the gutter being evacuated via the second openings to the buffer tanks, a third position higher than the first and second positions in which said mobile part is arranged above the level of the raised closing position of the platform, freeing the first openings of the water receiving gutter, forming the top position of the water collector system, said mobile part in this top position forming said anti-overflow peripheral barrier and said upper mouth system, the water propelled by the movements of the platform flowing through said circulation duct through first openings of the water receiving gutter.

According to one embodiment, the collector system comprises at least one actuator with three stable positions respectively configured to control the mobile part in said first position, said second position and said third position.

According to one embodiment, said actuator with three stable positions comprises:

an actuator rod fastened to the mobile part fastened to a cam mounted to pivot relative to the axis of the rod, said cam including cam lugs, a fixed cylinder including sloping notches, including first notches receiving the cam lugs in said blocking first position of said mobile part and second notches, at a lower level than the first notches, receiving the cam lugs in said second position of said mobile part, said first notches and the second notches being alternately distributed around the periphery of the fixed cylinder, a plunger coaxial with the fixed cylinder, received coaxially inside the fixed cylinder, configured to rise or to descend with no possibility of rotation about the axis of the fixed cylinder, having at its upper end a plurality of slopes, a pneumatic balloon received in the fixed cylinder in the uninflated state in the first position and in the second position of the mobile part and in the inflated state to actuate the plunger upon said mobile part rising into the third position, and in which said actuator is configured so that in each sequence of raising and lowering the plunger through the action of the pneumatic balloon the cam lugs then received in the first notches (or alternatively said second notches) are raised by the plunger, the slopes of the plunger bringing about after disengagement of the cam lugs from the first notches (or alternatively the second notches) the partial pivoting of the cam and the cam lugs, up until the descent of the plunger in which said partially pivoted lugs come to interengage with the second notches (or alternatively said first notches), thereby achieving the passage from the second state to the first state of the water collector system, or vice-versa.

According to one embodiment, the pool, including the main tank, the buffer tanks, the side walls, the circulation duct, the moveable platform, the actuator systems, the water collector system, the hollow structure, forms a self-supporting one-piece assembly.

The pool may be buried so that the peripheral floor of the pool is substantially constructed at the height of the walking surface of said collector system in said bottom position of said collector system.

BRIEF DESCRIPTION OF THE DRAWINGS

The invention will be better understood on reading the following description accompanied by the appended drawings, in which.

DETAILED DESCRIPTION

Figure 1:
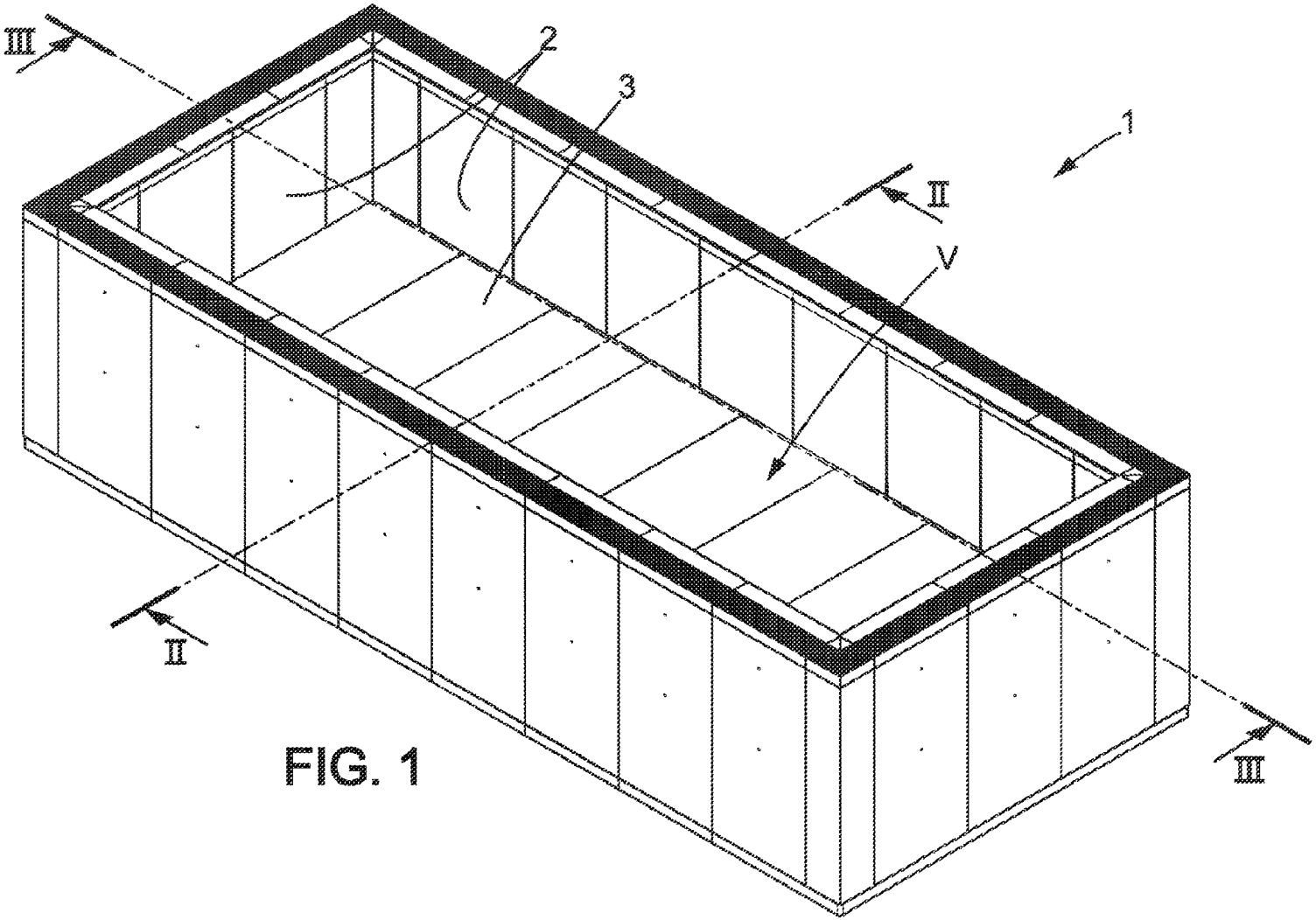
FIG. 1 is a perspective view of one embodiment of an overflow pool with a movable bottom.
Figure 2:
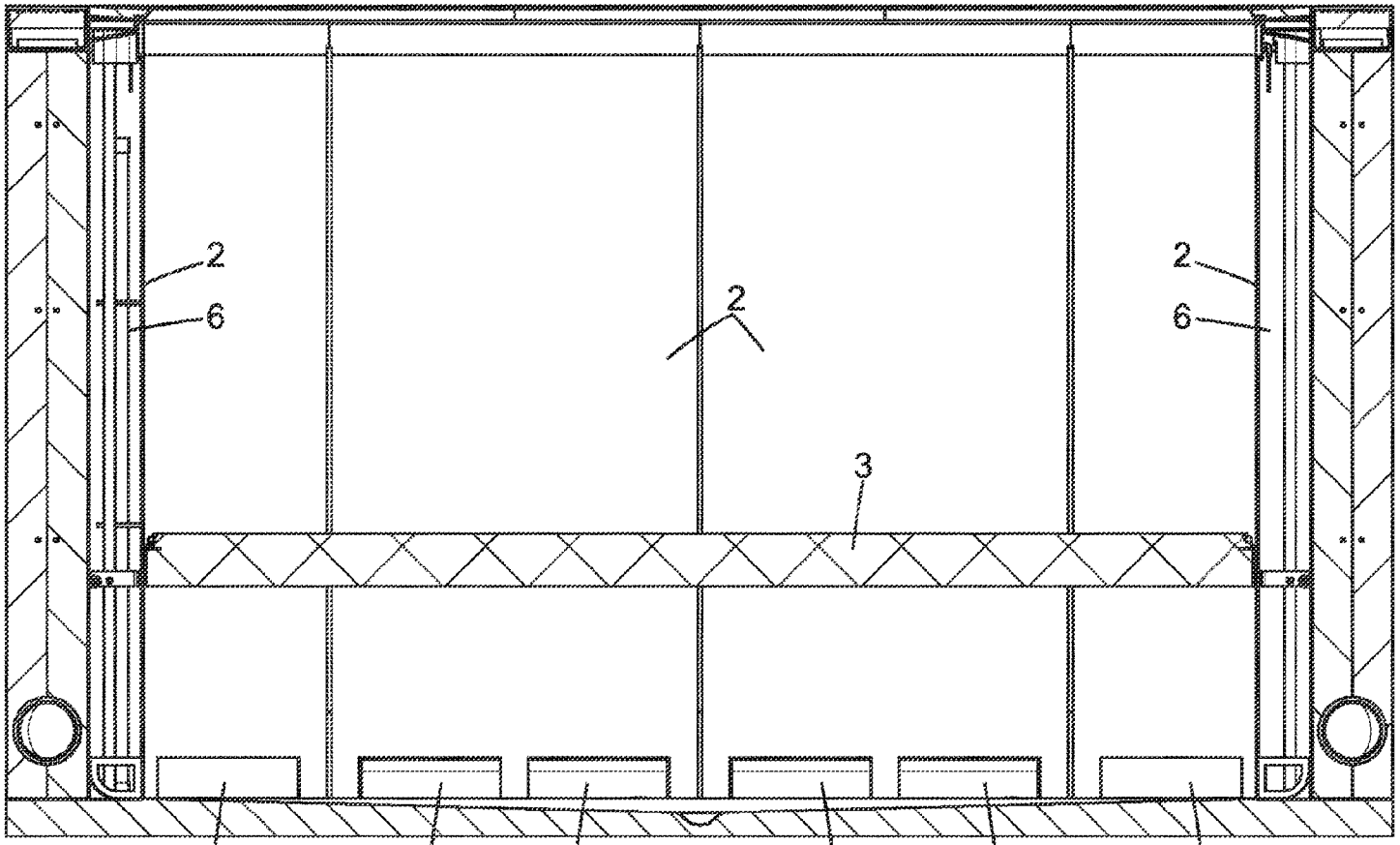
FIG. 2 is a view in section on the vertical section plane I-I in FIG. 1.
Figure 3:
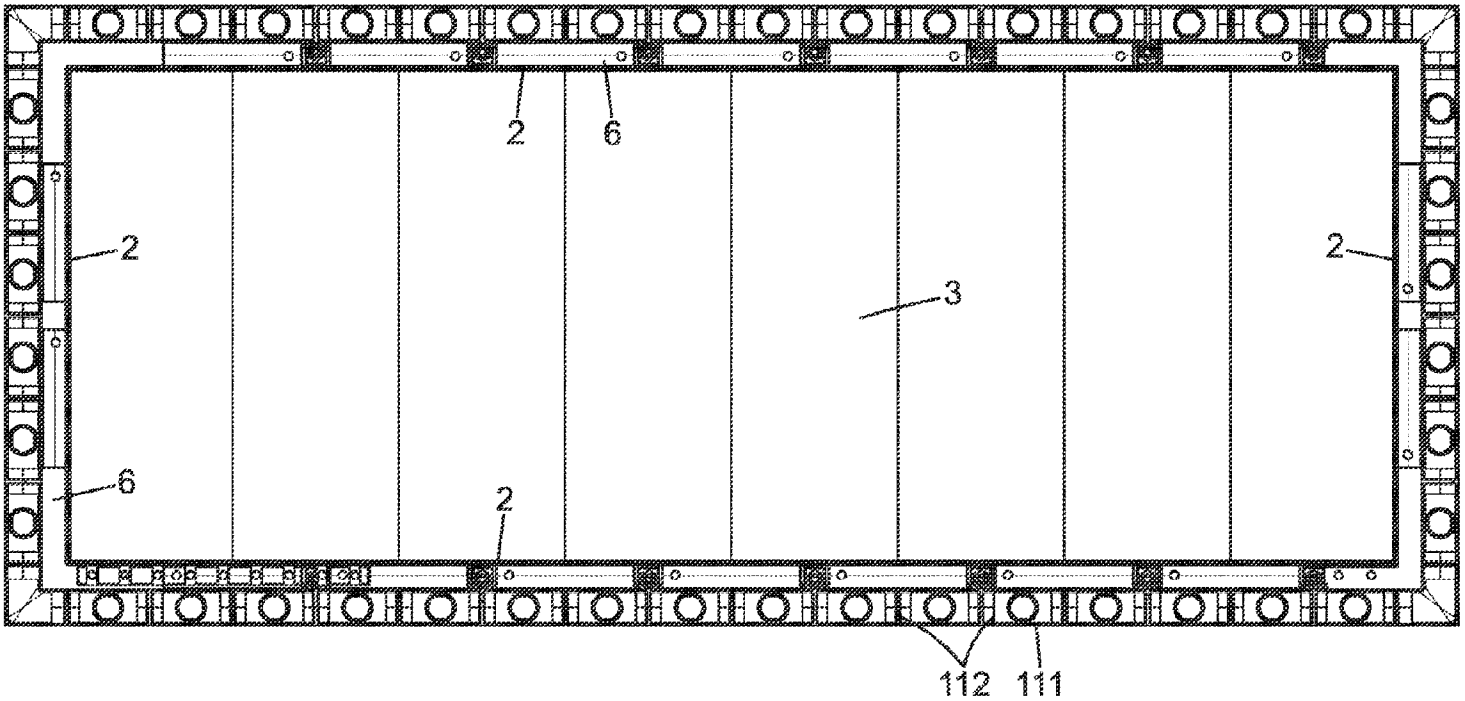
FIG. 3 is a view in section on the horizontal section plane II-II in FIG. 2.
Figure 4:
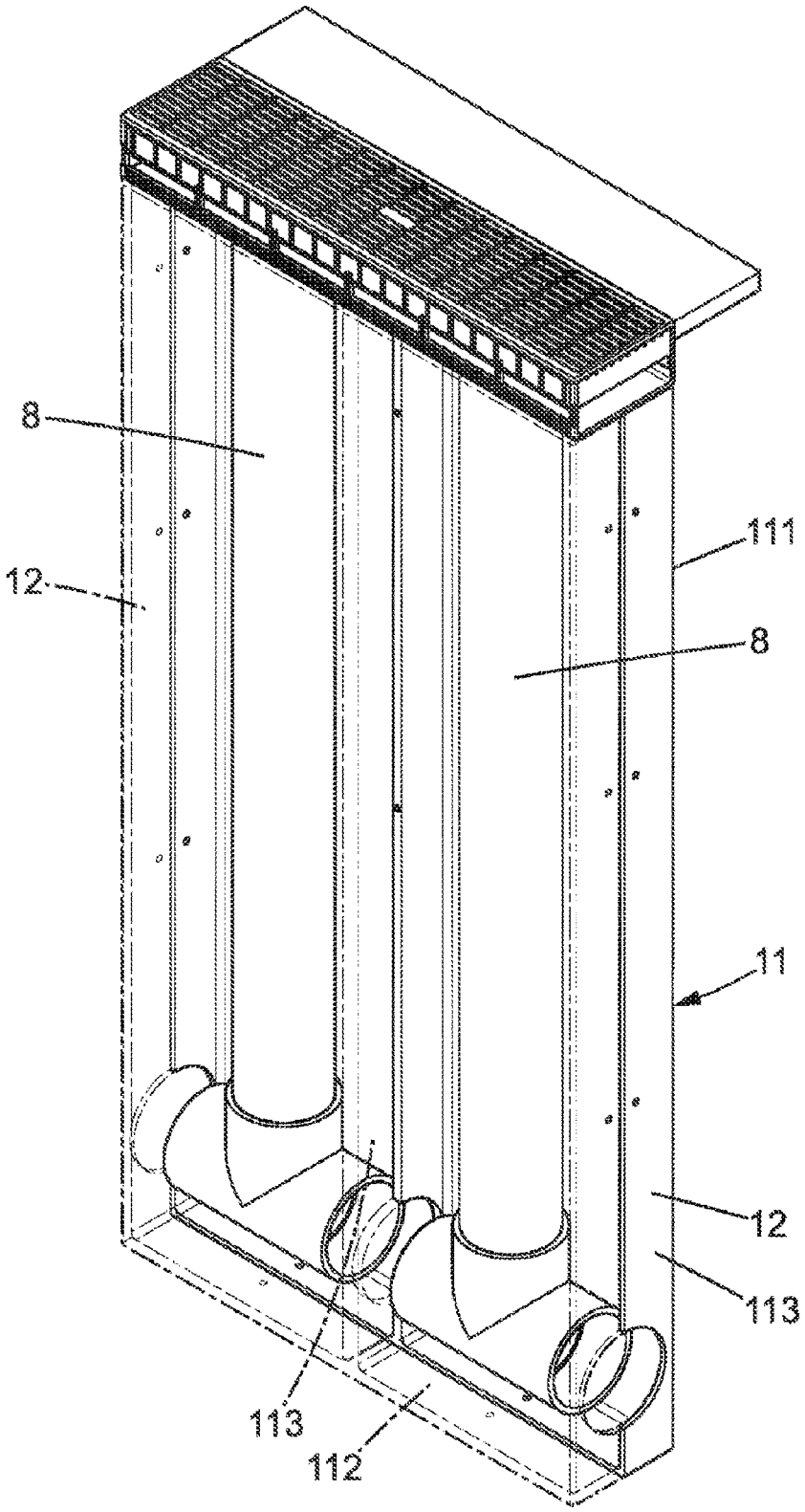
FIG. 4 is a detail view of a section of peripheral length of the pool, showing in detail a hollow structure receiving the buffer tanks and the water collector system above the hollow structure.

Also the invention relates to a pool 1 with a mobile bottom comprising:

- side walls 2 and a mobile platform 3 defining between them the bathing volume of the pool, the platform being able to pass from at least one immersed bottom position to a raised position Pf in the open air, closing the bathing volume V,
- a system 4, 5 for actuating said mobile platform 3 to raise it or to lower it,
- a peripheral circulation duct 6 disposed at the periphery of the bathing volume and of said side walls 2, said circulation duct 6 including an upper mouth system 60 and a lower mouth system 61 communicating with the bathing volume so as to allow, through the action of the mobile platform 3, water to circulate through said circulation duct 6, on either side of the mobile platform 3, from the upper mouth system 60 to the lower mouth system 61 during the ascent of said mobile platform 3, and from the lower mouth system 61 to the upper mouth system 60 during the descent of said mobile platform 3.

Figure 8:
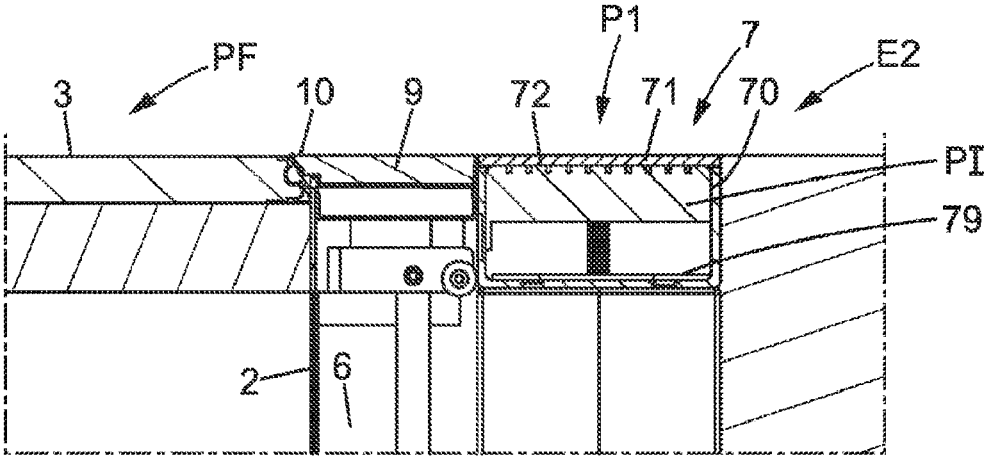
FIG. 8 is a view of the second state of said collector system in the bottom position P1 of the collector system and with the platform in the raised closing position Pf providing the thermal insulation of the pool.

Movable Platform and Circulation of Water Via the Circulation Duct During Movement of the Platform:

In the closing position Pf the movable platform 3 advantageously enables a floor to be constituted extending the floor at the periphery of the pool, as shown by way of illustration in FIG. 8.

The circulation duct 6 allowing circulation of water on either side of the movable platform during its movement advantageously make it possible:

- to limit the functional clearance between the peripheral edge of the platform and the side walls 2, in particular to less than 2 cm, preferably less than 1 cm; limiting this clearance makes it possible to limit the risks of pinching and to limit smaller objects falling under the platform,
- to use for the movable platform an airtight and even preferably thermally insulative platform with the objective of drastically limiting the heat exchanges between the water contained in the pool and the exterior when the movable platform is in the raised closing position Pf: in other words, in the raised closing position Pf the mobile platform constitutes a cover closing the bathing volume and limiting heat losses to the outside environment.

Overflow Pool:

According to the invention, said pool is an overflow pool comprising:

- a main tank containing the overflowing water from the bathing volume, receiving said side walls 2, the circulation duct 6 and the mobile platform 3,
- one or more secondary tanks for collecting overflowing water, with a buffer function, termed buffer tanks 8,
- a pump system connecting the buffer tanks 8 and continuously feeding the overflowing bathing volume with water from the buffer tanks 8.

The buffer tank or tanks 8 is or are separate from the main water tank: they are necessary for the overflow pool to function. Their function is to produce a constant water level in the main tank functioning in overflow mode, whatever the bathing conditions (for example the number of bathers present in the bathing volume) and/or external conditions (for example the presence of surplus water because of rain).

Operation of the Water Collector System:

Also noteworthy is that said pool comprises a water collector system 7 at the periphery of the bathing volume for collecting water overflowing at the periphery of the bathing volume.

Figure 6:
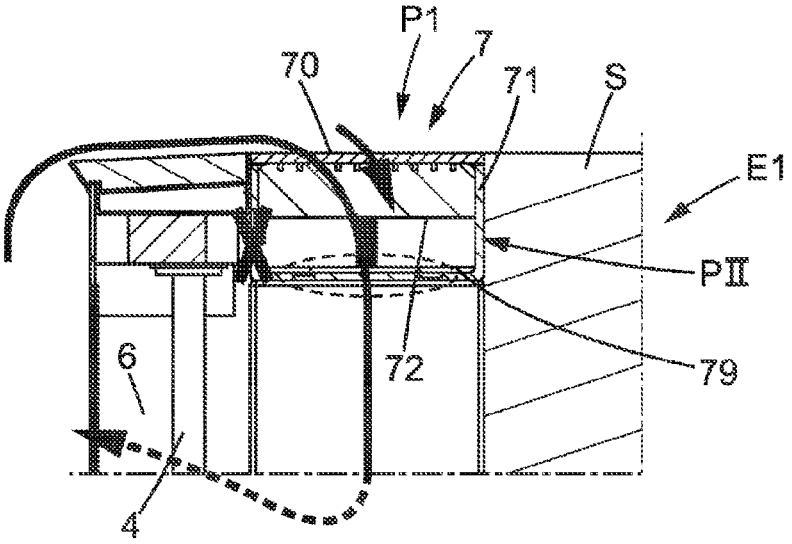
FIG. 6 is a detail view of the collector system in its bottom position in the first state of said collector system, the blocking and branch member in said second position allowing the collection of overflowing water falling into the gutter, through the grille, the collected water being directed into the buffer tanks.
Figure 7A:
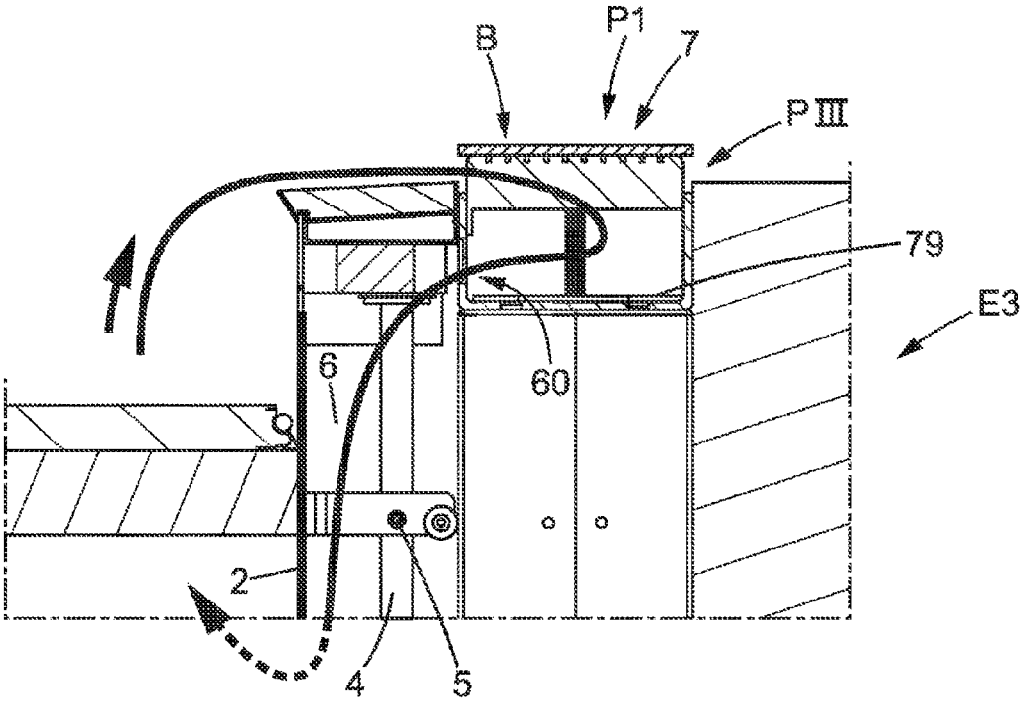
FIG. 7*a* is a detail view of the collector system in its top position in the third state of said collector system in which the collector system forms an anti-overflow barrier and constitutes the upper mouth system of the circulation circuit via which water enters during raising of the movable platform.
Figure 7B:
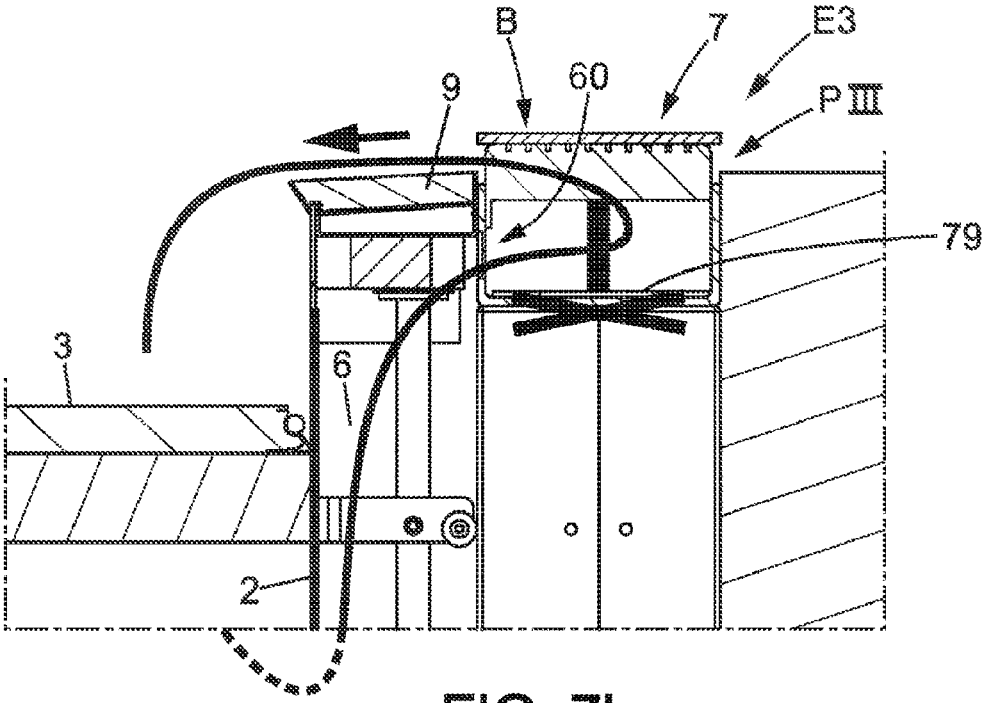
FIG. 7*b* is a detail view of the collector system in its top position in the third state of said collector system in which the collector system forms an anti-overflow barrier and constitutes the upper mouth system of the circulation circuit via which water exits during lowering of the movable platform.

It is noteworthy that, according to the invention, said overflow water collector system 7 is mobile, at least in part, being able to move:

- from a bottom position P1 in which the water collector system, on the one hand, constitutes an overflow defining the height of the overflow, receiving water when the pool functions in overflow mode (see FIG. 6), the then static mobile platform 3 in at least one immersed bottom position in a first state E1 of said collector system 7 allowing the collected water to flow to the buffer tank or tanks 8, and, on the other hand, constitutes a walking surface substantially at the level of the mobile platform then in the raised position Pf closing the bathing volume, in particular in a second state E2 (see FIG. 8) of said collector system,
- to a top position P2, situated above the level of the raised closing position Pf of the mobile platform 3, in which top position the water collector system 7 constitutes an anti-overflow peripheral barrier B during rising and descending movements of the mobile platform 3, in a third state E3 of said collector system, and then constitutes the upper mouth system 60 of the circulation circuit 6 through which water enters during raising of the mobile platform 3 (see FIG. 7*a*) or water exits during lowering of the mobile platform 3 (see FIG. 7*b*).

As shown in FIG. 6, in the bottom position P1 of said collector system 7, and at least in a first state E1 of said collector system, the latter constitutes the overflow that defines the depth of the water in the bathing volume, which may advantageously be substantially at the height of the floor S at the periphery of the pool: an overflow pool is obtained with a very successful aesthetic with a "mirror" effect, namely a water level substantially at the height of the floor at the periphery of the pool. The water collected by the system 7 is fed to the buffer tank or tanks 8.

As shown in FIG. 8, and in the bottom position P1 of said collector system, in particular in a second state E2 of said collector system and when the movable platform 3 is in the raised closing position Pf, the walking surface of the movable platform 3 extends the floor S at the periphery of the pool as well as the walking surface of the intermediate collector system 7, and even an intermediate curb 9 forming a surface that is advantageously plane, namely with no significant height discontinuity on which a user could stub their toe or trip. In this position the movable platform 3 advantageously enables the pool to be effectively insulated when not in use in order to prevent heat losses.

According to tests carried out by the inventor in a pool of this kind, during movements that raise or lower the platform a slight increase in the water surface level is observed: in said top position P2 the collector system advantageously constitutes an anti-overflow barrier that addresses this slight increase in level.

Accordingly, as shown in FIG. 7*a*, in the top position P2 of said collector system, and during rising movements of the platform, the collector system 7 constitutes a peripheral anti-overflow barrier above the raised closing position Pf of the platform that makes it possible to be sure that water pushed up by the movable platform 3 is all collected in the water collector system 7 that then constitutes the upper mouth system 60 of the circulation duct 6: the water collected in this way in the system 7 is fed via the circulation duct 6 to the lower mouth system 61 via which water exits under the movable platform 3.

Finally, as shown in FIG. 7*b*, in the top position P2 of said collector system, and during descending movements of the movable platform 3, the collector system constitutes a peripheral anti-overflow barrier above the raised closing position Pf of the platform, which makes it possible be sure that the water pushed up by the movable platform 3, entering via the lower mouth system 61, passing through the circulation duct 6 and exiting via the upper mouth system 60, is properly confined in the main tank with no risk of overflowing beyond the floor S at the periphery of the pool.

Advantages of the Invention

There is thus obtained an overflow pool with a movable bottom having all the advantages of a mirror effect overflow pool and a pool with a movable bottom.

The invention advantageously makes it possible to eliminate the main disadvantage of a prior art overflow pool, namely the serious heat losses (when not in use) when the platform 3 is in the closing position.

In this raised closing position Pf the movable platform extends the peripheral floor, advantageously with no discontinuity of level between the movable platform and the floor.

Overall Structure of the Pool

According to one embodiment, said water circulation duct 6 is at the periphery, defined by the interior space of a double wall formed between a watertight exterior envelope of the pool defining the main water tank and said side walls 2 inside the watertight exterior envelope, said side walls 2 being immersed to their full height, at least during operation in overflow mode.

The water collector system 7 may be situated outside the double wall forming the circulation duct 6, the pool including a peripheral curb 9 covering the top of the interior space of the double wall, said curb being intended to be walked on.

The upper walking surface of the curb 9 is situated at the height of the walking surface of the water collector system 7 in said bottom position P1 of said collector system (at least in the raised closing position Pf of the platform) so that the walking surfaces respectively belonging to the movable platform 3 then in the raised closing position Pf of the movable platform 3, to the curb 9 and to the collector system 7 are extended, advantageously and in particular with no discontinuity of level. In other words, and as can be seen in FIG. 8, in this position the user can move from the movable platform 3 in position Pf to the floor S at the periphery of the pool with no risk of the curb 9 or the collector system constituting a physical abutment they are liable to strike.

Said curb 9 is moreover configured so that water overflowing from the bathing volume flows over the curb to the collector system 7 when the pool functions in overflow mode (see FIG. 6) or again during rising movements of the movable platform (see FIG. 7*a*). During descending movements of the movable platform 3 the water exits via the collector system and flows over the curb 9 into the bathing volume (see FIG. 7*b*).

The upper surface of the curb 9 may have a (slight) slope relative to the horizontal when the pool is functioning in overflow mode (or during rising or descending movements of the platform and as can be seen in FIGS. 6, 7*a* and 7*b*): this slope is an upward slope from the bathing volume to the collector system 7. At the top end of travel, the movable platform 3 may entrain the curb 9, which pivots slightly to a position in which its upper surface, then substantially horizontal, extends the movable platform (then in the raised closing position Pt) and the walking surface of the collector system 7.

In one embodiment shown here, the buffer tanks 8 may be received at the periphery, outside the double wall forming the circulation duct 6, received in a hollow structure 11, the water collector system 7 being situated vertically above the hollow structure, laterally with respect to the circulation duct 6.

The hollow structure 11 may extend all around the periphery of the double wall forming the circulation duct 6, forming a plurality of vertical box sections 12 distributed around the periphery, said buffer tanks 8 being received in respective vertical box sections 12.

This hollow structure 11 advantageously forms the peripheral watertight envelope that makes it possible to contain the pressure of the volume of water in the main tank: the peripheral interior vertical side wall 111 of this structure 11 is preferably watertight and constitutes the exterior vertical wall of the double wall forming the circulation duct 6, a parallel opposite second side wall 112 being able to constitute the exterior lateral envelope of the pool. Vertical walls 113 extend regularly at the periphery, perpendicularly to the walls 111 and 112, and make it possible to partition the peripheral internal space between the two walls 111 and 112 to form the plurality of vertical box sections 12. These vertical partitions 113 have the function of stiffening the hollow structure 11 that is subjected to the pressure of the volume of water on its interior wall 111, and therefore to limit bowing of the wall 111 by the effect of the pressure.

A thermal insulation, such as synthetic foam (expanded polystyrene, extruded polystyrene, polyurethane, phenolic foam or the like) enables the hollows of the structure 11, and in particular each buffer tank 8, to be filled from the outside, the insulation received filling the interior space between the buffer tank 8 and the interior walls of the box section 12. This therefore limits heat losses from the sides of the pool.

Also with the aim of limiting heat losses, a seal system 10 can make it possible to provide a watertight closure between the movable platform 3 and the curb 9 in said raised closing position Pf of the movable platform, as shown in FIG. 8.

Structure of the Water Collector System:

The structure of one possible embodiment of the water collector system 7 shown in FIGS. 1 to 8 is described hereinafter.

Figure 5:
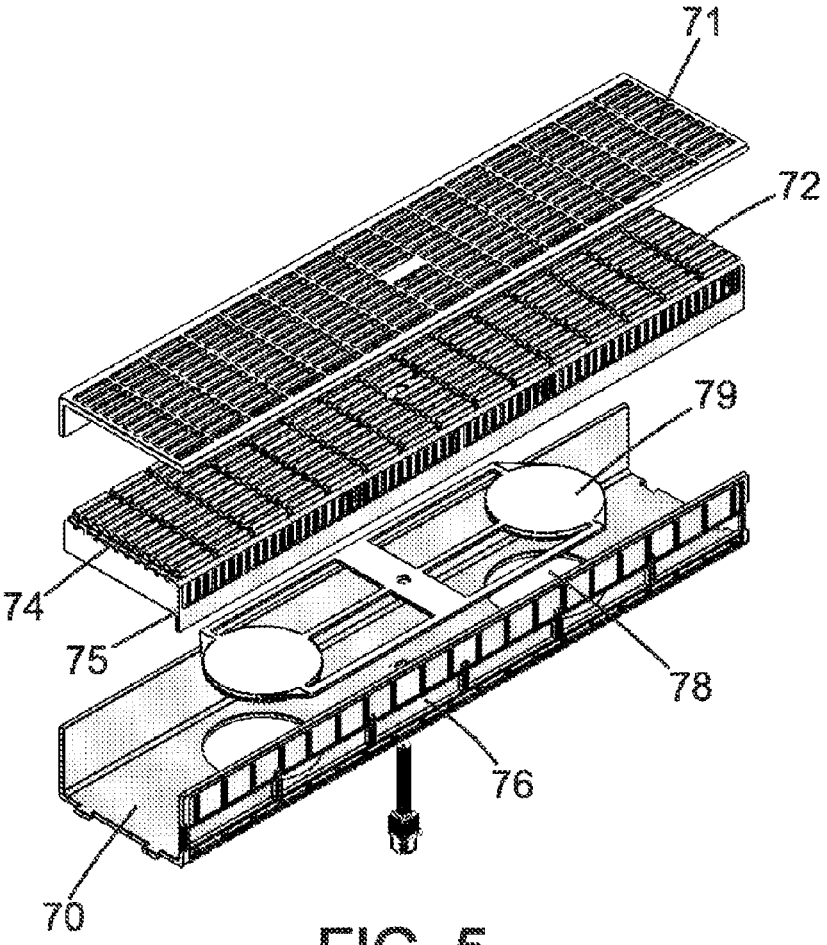
FIG. 5 is an exploded view showing the various members of the water collector system, including the water receiving gutter, the grille, the blocking and branch member, the system for blocking the second openings, and a lead screw type actuator.

In a non-limiting embodiment shown in FIG. 5, the overflowing water collector system 7 may comprise a gutter 70, a grille 71, a blocking and branch member 72, or even a blocking system 79.

The water receiving gutter 70 extends all around the periphery of the bathing volume: it is locally of U-section, comprising a bottom wall and two projecting side walls, extending on respective opposite sides of the bottom wall, defining an opening at the top of the water receiving gutter. The interior side wall situated on the same side as the bathing volume includes first openings 76 in communication with the circulation duct 6. The gutter further includes second openings 78, in particular on the bottom wall, in communication with the buffer tanks 8.

The substantially horizontal grille 71 covers the opening at the top of the water receiver gutter 70. The upper surface of the grille 71 moreover constitutes the walking surface of the water collector system 7.

The blocking and branch member 72 is inside the gutter 70 and vertically mobile relative to the gutter.

This mobile member is able to assume three positions, shown in FIGS. 6 to 8:

- a top first position PI in which the blocking and branch member 72 blocks the grille in the bottom position P1 of the water collector system 7 then in said second state E2 in which the mobile platform 3 is in the raised position Pf closing the pool, as shown by way of example in FIG. 8,
- a second position PII lower than the first position in which the blocking and branch member 72 frees the openings of the grille 71, in the bottom position P1 of the water collector system in which the mobile platform is static, in the immersed bottom position, allowing overflowing water to pass through the grille 71 and drop into the water receiving gutter 70, the blocking and branch member 72 blocking the first, in particular lateral openings 76 of the gutter, the water collected in the gutter being evacuated via the second openings 78 to the buffer tanks 8 as shown for example in FIG. 6,
- a third position PIII higher than the first and second positions in which the blocking and branch member 72 picks up and supports the grille 71 above the level of the raised closing position Pf of the platform, freeing the first openings 76 of the water receiving gutter, constituting the top position P2 of the water collector system 7, the blocking and branch member constituting in this top position said anti-overflow peripheral barrier B, the water propelled by the movements of the platform flowing through said circulation duct 6, through the first openings 76 of the water receiving gutter as shown for example in FIGS. 7*a* and 7*b*.

The blocking and branch member 72 is a body preferably extending the full length of the grille the upper surface of which includes for example studs 74 blocking the openings of the grille in position PI, as shown in FIG. 8.

One of the side faces 75 sliding along the side wall of the trough situated on the same side as the bathing volume has an unperforated bottom part adapted to block the first openings 76 in position PII of said blocking and branch member 72 and a perforated upper part allowing water to pass through the side wall in the third position PIII of said blocking and branch member 72, as shown in FIG. 7*a* or 7*b*.

Said blocking and branch member 72 can be actuated to raise or to lower it by an actuator such as a motorized lead screw, as shown in FIG. 5 in which the screw cooperates with a nut fastened to the body of the member 72.

The blocking system 79 is inside the gutter, situated between the bottom of the gutter and the member 72. This blocking system 79 closes the second openings 78 when the collector system 7 is in the top position P2 and so that water flows through the first openings 76 and, secondly, opens the second openings 78 in the first state E1 of the collector system when the collector system is in the bottom position P1 and so that the overflowing water collected in the gutter is directed to the buffer tanks 8.

This blocking system 79 may be one moving vertically, as shown in the figures, or again moving horizontally, sliding along guides on the bottom of the gutter.

The structure of one possible embodiment of the water collector system 7 shown in FIGS. 9 to 16 is further described.

This overflowing water collector system 7 comprises:

- a U-section water receiving gutter 70 comprising a bottom wall and two side walls extending on respective opposite sides of the bottom wall, the interior side wall situated on the same side as the bathing volume including first, in particular lateral openings 76 in communication with the circulation duct 6 and second, in particular bottom openings 78 in communication with the buffer tanks 8,
- a static part 701 covering the gutter 70 and forming a walking surface substantially at the level of the mobile platform then in the raised position Pf closing the bathing volume, said static part 701 defining said bottom position P1 of said collector system, an interior space It separating said static part 701 from the curb 9 forming an upper opening for the gutter 70.

Figure 9:
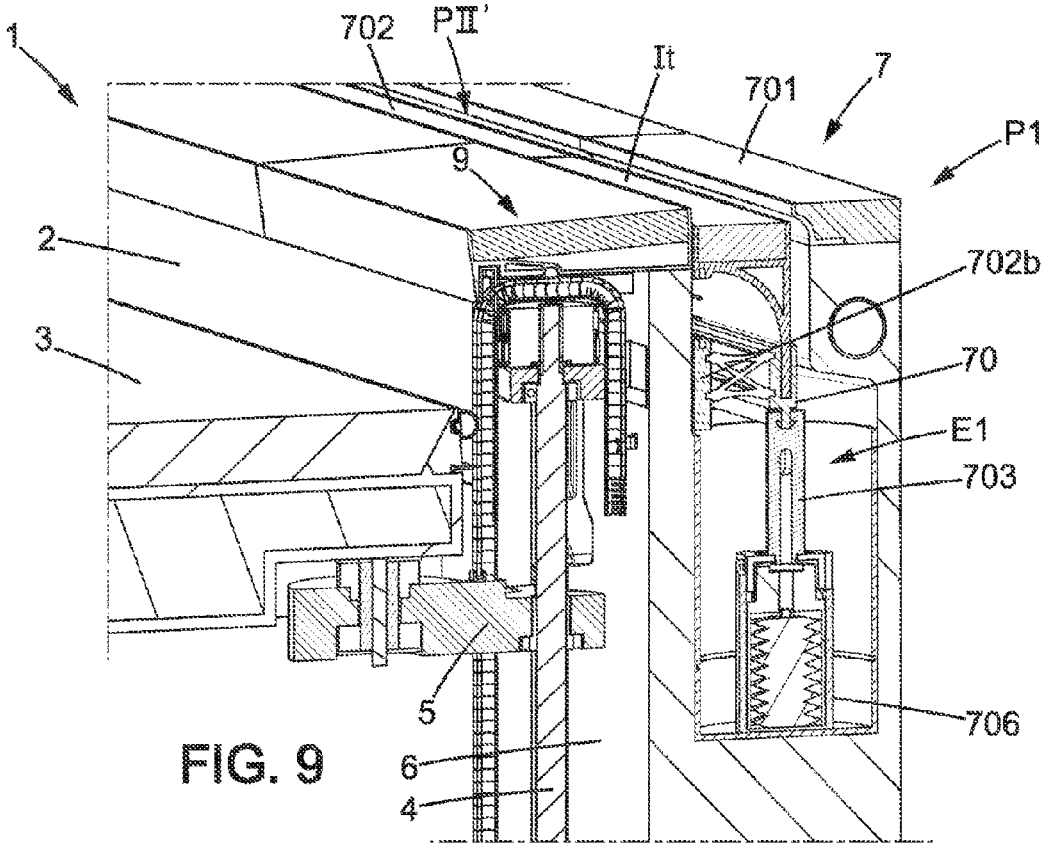
FIGS. 9 and 10 are views in section on a vertical plane of a second embodiment of a pool according to the invention, more particularly showing the collector system in its bottom position in the first state of said collector system allowing the collected water to flow to the buffer tank or tanks.
Figure 10:
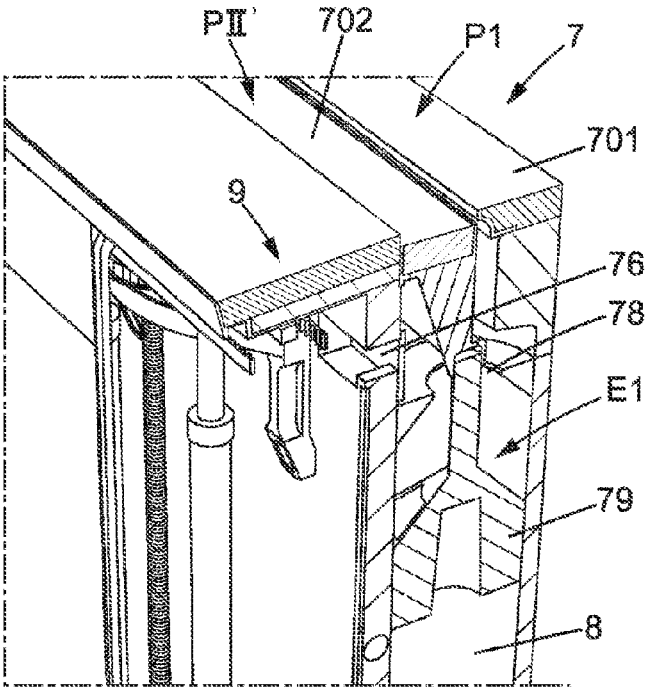
Figure 12:
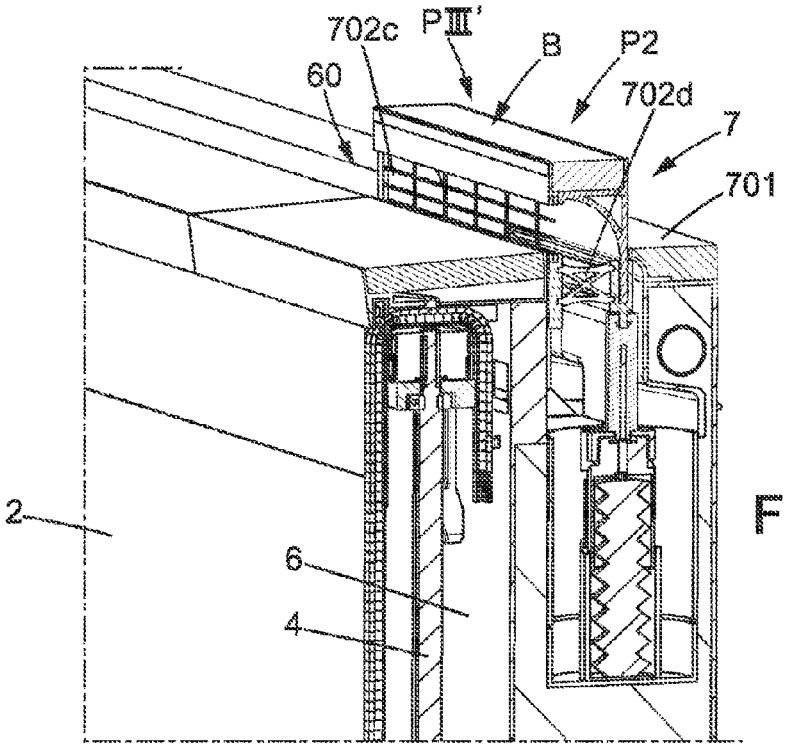
FIGS. 12 and 13 are views of the collector system from FIGS. 9 and 10 in its top position in the third state of said collector system in which the collector system forms an anti-overflow barrier and constitutes the upper mouth system of the circulation circuit through which water enters during raising of the movable platform (or water exits during lowering of the movable platform)
Figure 13:
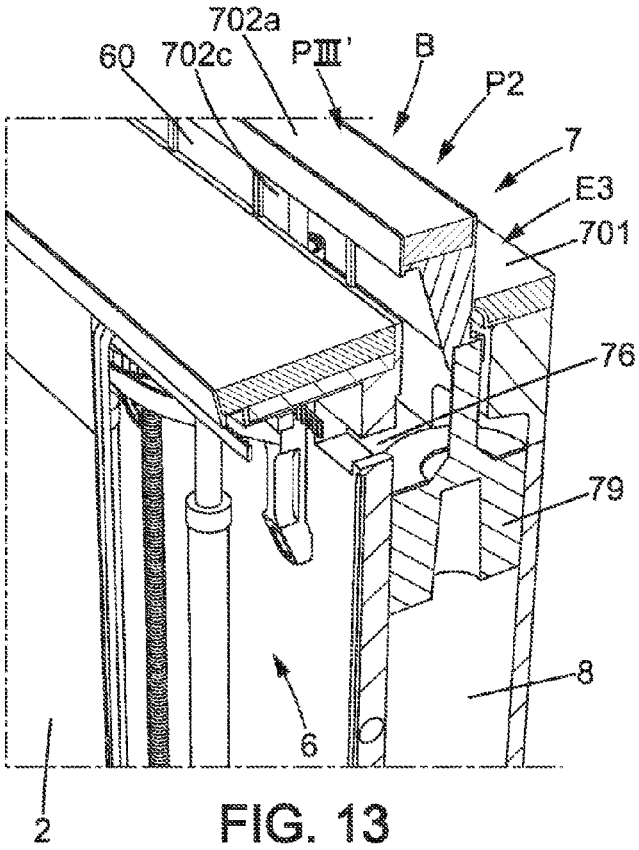
Figure 14:
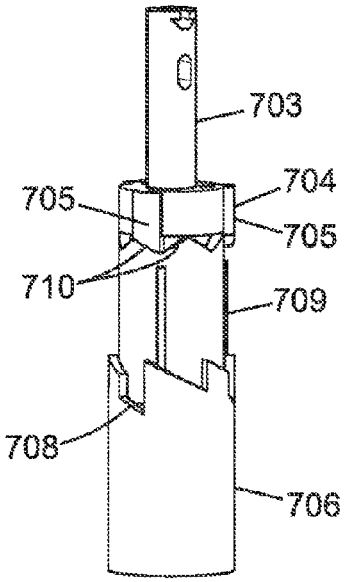
FIG. 14 is a view of the actuator controlling a mobile part of the collector system from FIG. 12 producing the third state of said collector system, in the top position of the actuator allowing the water to flow to the circulation duct.
Figure 15:
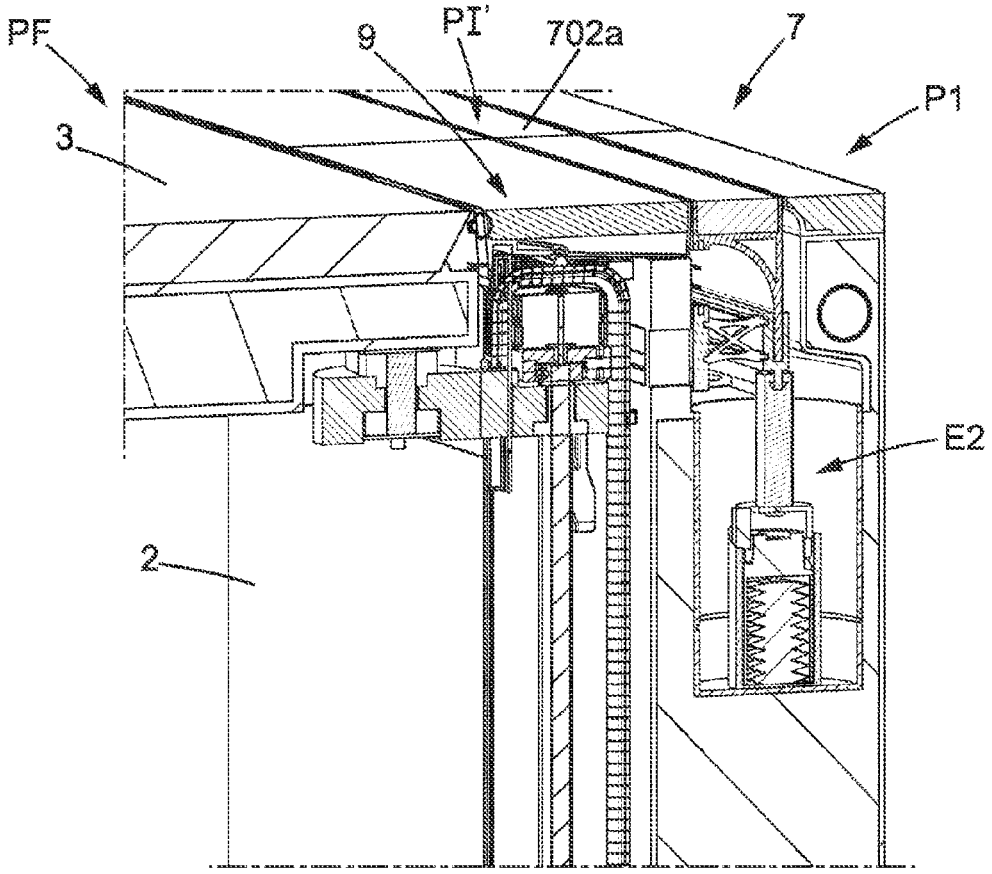
FIG. 15 is a view in section corresponding to FIG. 9 in the bottom position of the collector system in the second state of said collector system in which the collector system constitutes a walking surface substantially at the level of the movable platform then in the raised position closing the bathing volume, 13
Figure 16:
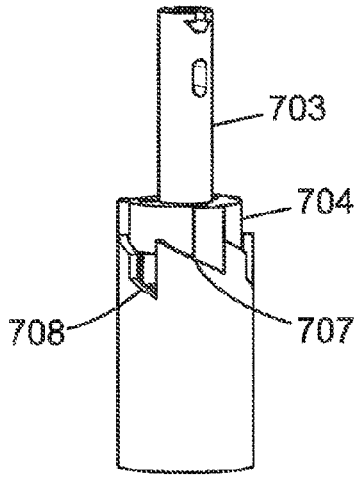
FIG. 16 is a view of the actuator controlling a mobile part of the collector system from FIG. 8 producing the second state of said collector system, in a bottom second position of the actuator blocking the collector system.

In particular the system 7 further comprises:

- a mobile part 702 inside the gutter 70 and mobile relative to the gutter 70 and to said static part 701 being able to assume three positions:
  - a blocking first position PI' in which said mobile part 702 blocks the interior space between the curb 9 and said static part 701, the water collector system 7 then in said second state E2 for which the mobile platform 3 is in the raised position Pf closing the pool, the upper surface of the mobile part 702 extending the walking surface of said static part 701: this first position PI' is shown by way of example in FIG. 15,
  - a second position PII' lower than the first position in which the mobile part 702 opens the water receiving gutter 70, allowing overflowing water to drop into the water receiving gutter 70, in said bottom position P1 of the water collection system then in the first state E1 in which the mobile platform is static, in the immersed bottom position, the mobile part 702 blocking the first, notably lateral openings 76 of the gutter, water collected in the gutter being evacuated via the second openings 78 to the buffer tanks 8: this second PII' is shown by way of example in FIGS. 9 and 10,
  - a third position PIII' higher than the first and second positions in which said mobile part 702 is arranged above the level of the raised and closing position Pf of the platform, freeing the first openings 76 of the water receiving gutter, forming the top position P2 of the water collector system 7, said mobile part 702 in this top position forming said anti-overflow peripheral barrier B and said upper mouth system 60, the water propelled by the movements of the platform flowing through said circulation duct 6, through first openings 76 of the water receiving gutter: this third PIII' is shown by way of example in FIGS. 12 and 13.

Note that the mobile part 702 comprises an upper wall 702*a* and a side wall 702*b* that blocks the first openings 76 in the second position PII' or frees the first openings 76 in the third position PIII'.

The mobile part 702 is fastened to a blocking system 79 that in position PII' opens the second openings 78 and in the position PIII' closes them.

The mobile part 702 forms the upper mouth system 60, in the position PIII', with side opening 702*c* oriented toward the bathing volume through which water is able to enter or exit during movements of the platform 3. The water inside the part 702 is guided by an internal wall 702*d* forming a deflector.

The collector system may comprise at least one actuator with three stable positions respectively configured for controlling the mobile part 702 in said first position PI', said second position PII' and said third position PIII'.

This actuator may advantageously be of the pneumatic type, avoiding the use of an electrical actuator in a humid environment.

For example, said actuator with three stable positions comprises:

- an actuator rod 703 fastened to the mobile part 702 fastened to a cam 704 mounted to pivot relative to the axis of the rod, said cam including cam lugs 705,
- a fixed cylinder 706 including sloping notches 707, 708, including first notches 707 receiving the cam lugs 705 in said blocking first position PI' of said mobile part 702 and second notches 708, at a lower level than the first notches, receiving the cam lugs in said second position PII' of said mobile part 702, said first notches 707 and the second notches being alternately distributed around the periphery of the fixed cylinder 706,
- a plunger 709 coaxial with the fixed cylinder 706, received coaxially inside the fixed cylinder 706, configured to rise or to descend with no possibility of rotation about the axis of the fixed cylinder 706, having at its upper end a plurality of slopes 710,
- a pneumatic balloon 711 received in the fixed cylinder 706 in the uninflated state in the first position PI' and in the second position PII' of the mobile part 702 and in the inflated state to actuate the plunger upon said mobile part 702 rising into the third position PIII'.

Said actuator is advantageously configured so that in each sequence of raising and lowering the plunger through the action of the pneumatic balloon 711 the cam lugs 705 then received in the first notches 707 (or alternatively said second notches 708) are picked up by the plunger 709, the slopes 710 of the plunger bringing about after disengagement of the cam lugs 705 from the first notches or (alternatively the second notches) the partial pivoting of the cam and the cam lugs, up until the descent of the plunger 709 in which said partially pivoted lugs come to interengage with the first notches, or alternatively said second notches, thereby achieving the passage from the second state E2 to the first state E1 of the water collector system, or vice-versa.

This actuator sequence enabling the change from the first state E1 to the second state E2 of the collector system is described in detail hereinafter.

Figure 11:
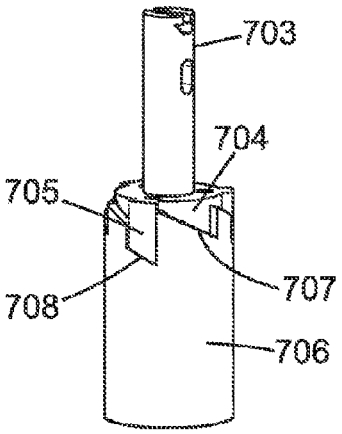
FIG. 11 is a view of the actuator controlling a mobile part of the collector system from FIG. 8, producing the first state of said collector system, in a bottom first position of the actuator allowing collected water to flow to the buffer tank or tanks.

FIG. 11 shows the actuator, the deflated pneumatic balloon 711 and the cam lugs 705 of the cam 704 received in the second notches 708 of the fixed cylinder defining the second position PII' of the mobile part 702 (first state E1).

Inflating the pneumatic balloon 711 causes the plunger 709 to rise and its slopes 710 to engage with the lugs 705 to raise the cam 704 and thus the rod 703 fastened to the mobile part 702.

As soon as the cam lugs 705 escape from the second notches 708 the cam lugs 705 slide along the slopes 710 of the plunger 709, causing the cam 704 and the lugs to rotate by a sufficient fraction of a turn to position the lugs in line with the adjacent notches of the fixed cylinder, namely the first notches 707. In the deployed position of the actuator (balloon inflated, FIG. 14) the third position PIII' of the mobile part 702 is obtained (FIGS. 12 and 13: third state E3).

When the pneumatic balloon 11 is deflated the plunger 709 descends under its own weight until the cam lugs 705 engage with the first notches 707, the cam lugs 705 then following the slope of these notches 707 until the lugs abut in these first notches (FIG. 16) producing the first position PI' of the mobile part (FIG. 15: second state E2).

Clearly the next sequence of raising and then lowering the actuator makes it possible to go from the second state E2 to the first state E1.

Generally speaking, the pool includes control means for actuating the pump system associated with the buffer tank or tanks only when the collector system is in the first state E1 (FIG. 6).

When the collector system is in the second state E2 and the platform is in the raised closing position Pf a set of internal nozzles associated with pumps enables agitation of the water confined in the main tank and the secondary tanks in order to prevent the presence of stagnant water.

The system for actuating the platform may comprise a plurality of actuators 4, 5 received in the double wall forming the circulation duct 6, each actuator comprising a lead screw system including:

- a substantially vertical motorized lead screw 4 received in the double wall of the circulation duct 6,
- a nut fastened to a support 5 projecting laterally from the mobile platform 3 and cooperating with the lead screw.

This support 5 extends from the platform 3 from the bathing volume, through a vertical slot in the side wall 2 and into the duct 6 where it is provided with a nut cooperating with the screw 4.

The pool, including the main tank, the buffer tanks 8, the side walls 2, the circulation duct, the mobile platform 3, the actuator systems 4, 5, the water collector system 7 and the hollow structure 11 constitutes a (self-supporting) one-piece assembly, which may be prefabricated, or even delivered in kit form for assembly on site.

During installation the pool may be buried so that the floor S (the ground) at the periphery of the pool is substantially constructed at the height of the walking surface of said collector system in said bottom position P1, as shown in FIGS. 6 and 8.

Thanks to the hollow structure 11 that makes it possible to contain the pressure of the water and its self-supporting design, the pool may be installed above ground, for example on a concrete slab: in this case a floor is constructed at the periphery of the pool the height of which is substantially level with the mobile platform when in the raised closing position.

Other embodiments could naturally have been envisaged without departing from the scope of the invention as defined by the following claims

PARTS LIST

1. Pool,
2. Side walls,
3. Mobile platform,
4. Lead screw (platform actuator),
5. Support with nut (platform actuator),
6. Circulation duct,
60. Upper mouth system (circulation duct 6),
61. Lower mouth system (circulation duct 6),
7. Overflowing water collector system,
70. Receiving gutter,
71. Grille (embodiment from FIGS. 1 to 8),
72. Blocking and branch member (embodiment from FIGS. 1 to 8),
74. Blocking and branch member studs (for blocking the grille),
75. Side faces,
76. First gutter openings (in communication with the circulation duct 6),
78. Second gutter openings (in communication with the circulation duct 6),
79. Blocking system (second openings),
701. Static part (embodiment from FIGS. 9 to 16),
702. Mobile part (embodiment from FIGS. 9 to 16),
702*a*. Upper wall (mobile part),
702*b*. Side wall,
702*c*. Side opening,
703. Actuator rod,
704, 705. Cam and cam lugs,
706. Fixed cylinder,
707,708. First and second sloping notches (fixed cylinder),
709. Plunger,
710. Slopes (plunger upper end),
711. Pneumatic balloon,
8. Buffer tanks,
9. Curb,
10. Sealing system (seal between curb and platform in raised closing position),
11. Hollow structure (receiving the buffer tanks),
111, 112. Vertical side walls,
113. Vertical partitions,
12. Vertical box sections (hollow structure),
V. Bathing volume,
Pf. Raised closing position of the mobile platform,
P1. Bottom position of collector system,
P2. Top position of collector system,
PI,PII,PIII. First, second and third position of blocking and branch member (embodiment from FIGS. 1 to 8),
PI',PII',PIII'. First, second and third position of said mobile part (embodiment from FIGS. 9 to 16),
E1. First state of the collector system (in bottom position P1 of the system and with the platform lowered as in FIG. 6 or as in FIG. 9) for collecting overflowing water and feeding it to the buffer tank,
E2. Second state of said collector system (in bottom position P1 of the system and with the platform in the raised closing position according to FIG. 8 or according to FIG. 15) for thermal insulation of the pool,
E3. Third state of said collector system (in the top position P2 of said collector system according to FIGS. 7*a* and 7*b* or according to FIGS. 12 and 13) in which the collector system forms an anti-overflow barrier and constitutes the upper mouth system of the circulation circuit through which water enters during raising of the mobile platform or water exits during lowering of the mobile platform,
B. Peripheral barrier
S. Peripheral floor.

The invention claimed is:

1. A pool with movable bottom and comprising:

side walls and a mobile platform defining therebetween a bathing volume of the pool, said mobile platform configured to pass from at least one immersed bottom position to a level of a raised closing position in which the mobile platform is raised in the open air and closes the bathing volume, a system for actuating said mobile platform configured to raise or to lower said mobile platform, a peripheral circulation duct disposed at the periphery of the bathing volume and of said side walls, said circulation duct including an upper mouth system and a lower mouth system communicating with the bathing volume and being configured to enable water to circulate through said circulation duct, on either side of the mobile platform, by raising and lowering of the mobile platform, wherein raising the mobile platform enables the water to circulate from the upper mouth system to the lower mouth system and lowering the mobile platform enables the water to circulate from the lower mouth system to the upper mouth system, wherein said pool is an overflow pool comprising:

a main water tank configured to contain overflowing water from the bathing volume, receiving said side walls, the circulation duct and the mobile platform, one or more buffer tanks configured to collect overflowing water and to buffer the overflowing water, a pump system configured to connect to the one or more buffer tanks and to continuously feed the overflowing water from the with water from the one or more buffer tanks, and a water collector system extending at the periphery of the bathing volume and adapted to collect water overflowing at the periphery of the bathing volume, said water collector system being configured to be, at least in part, mobile and able to pass:

from a bottom position in which the water collector system is configured to: (i) be an overflow defining a height of the overflow and receive water when the pool functions in overflow mode, the mobile platform being static in at least one immersed bottom position, in a first state of said collector system, thereby allowing the collected water to flow to the one or more buffer tanks, and (ii) be a walking surface substantially at the level of the mobile platform the raised closing position in a second state of said collector system, to a top position, situated above the level of the raised closing position of the mobile platform, at which the water collector system is configured to be an anti-overflow peripheral barrier during raising and lowering of the mobile platform, in a third state of said collector system, such that the water collector system is configured to be the upper mouth system of the circulation circuit through which water enters during raising of the mobile platform or water exits during lowering of the mobile platform.

2. The pool as claimed in claim 1, wherein said water circulation duct is a peripheral duct defined by the interior space of a double wall formed between a watertight exterior envelope of the pool defining the main water tank and said side walls internal to the watertight exterior envelope such that at least during operation in overflow mode said side walls are fully immersed.

3. The pool as claimed in claim 2, wherein:

the water collector system is situated outside the double wall forming the circulation duct, the pool having a peripheral curb covering the interior space of the double wall, said curb being configured to be walked on, the curb has an upper surface situated at the height of the walking surface of the water collector system in said bottom position of said collector system, the walking surfaces respectively belonging to the mobile platform in the raised closing position of the mobile platform, to the curb and to the collector system are configured to extend with no discontinuity in level, and said curb is configured so that water overflowing from the bathing volume flows over the curb to the collector system during functioning of the pool in overflow mode or during raising movements of the mobile platform.

4. The pool as claimed in claim 2, wherein the one or more buffer tanks are received at the periphery in a hollow structure; outside the double wall forming the circulation duct, and the water collector system is situated vertically above the hollow structure, positioned laterally with respect to the circulation duct.

5. The pool as claimed in claim 4, wherein the hollow structure extends all around the periphery of the double wall forming the circulation duct, forming a plurality of vertical box sections, said vertical box sections being distributed along said periphery, and said one or more buffer tanks are respectively received in said vertical box sections.

6. The pool as claimed in claim 5, wherein a thermal insulation fills voids of the hollow structure and insulates outside of each buffer tank by filling interior space between each buffer tank and the interior walls of each box section of the hollow structure.

7. The pool as claimed in claim 3, wherein a sealing system is configured to provide a watertight closure between the mobile platform and the curb in said raised closing position of the mobile platform.

8. The pool as claimed in claim 3, wherein the overflowing water collector system comprises:

a U-section water receiving gutter comprising a bottom wall and two projecting side walls extending on respective opposite sides of the bottom wall and defining an upper opening of the water receiving gutter, an interior side wall situated in the bathing volume including lateral openings in communication with the circulation duct and bottom openings in communication with the one or more buffer tanks, a substantially horizontal grille comprising openings and covering the upper opening of the water receiving gutter and the substantially horizontal grille having an upper surface configured to form the walking surface, a blocking and branch member inside the water receiving gutter, the blocking and branch member being mobile relative to the water receiving gutter, said blocking and branch member being configured to assume three positions:

a top first position in which the blocking and branch member blocks the openings of the substantially horizontal grille in a bottom position of said water collector system in said second state of said water collector system when the mobile platform is in the raised closing position, thereby closing the pool, a second position lower than the first position in which the blocking and branch member frees the openings of the substantially horizontal grille, in the bottom position of the water collector system in which the mobile platform is static, in the immersed bottom position, allowing overflowing water to pass through the openings of the substantially horizontal grille and drop into the water receiving gutter, the blocking and branch member blocking the lateral openings of the water receiving gutter, the water collected in the water receiving gutter being evacuated via the bottom openings to the one or more buffer tanks, a third position higher than the first and second positions in which the blocking and branch member picks up and supports the substantially horizontal grille above the level of the raised closing position of the mobile platform, freeing the lateral openings of the water receiving gutter, constituting the top position of the water collector system, the blocking and branch member constituting in said top position said anti-overflow peripheral barrier, the water propelled by the movements of the platform flowing through said circulation duct, through the lateral openings of the water receiving gutter.

9. The pool as claimed in claim 8, further comprising a blocking system inside the water receiving gutter configured to close the bottom openings when the collector system is in the top position and so that water flows through the later openings and to close the bottom openings in the first state of the collector system when the collector system is in the bottom position and so that the overflowing water collected in the water receiving gutter is directed to the one or more buffer tanks.

10. The pool as claimed in claim 2, wherein the system for actuating the platform comprises a plurality of actuators received in the double wall forming the circulation duct, each actuator comprising:

a substantially vertical motorized lead screw received in the double wall, a nut fastened to a support projecting laterally from the mobile platform and cooperating with the lead screw.

11. The pool as claimed in claim 3, wherein the overflowing water collector system comprises:

a U-section water receiving gutter comprising a bottom wall and two side walls extending on respective opposite sides of the bottom wall, an interior side wall situated in the bathing volume including lateral openings in communication with the circulation duct and bottom openings in communication with the one or more buffer tanks, a static part covering the water receiving gutter and forming a walking surface substantially at the level of the mobile platform, said static part closing the bathing volume when the mobile platform is in the raised closing position, said static part defining said bottom position of said collector system, an interior space separating said static part from the curb forming an upper opening for the gutter, a mobile part inside the gutter and mobile relative to the gutter and to said static part, said mobile part being configured to assume three positions:

a blocking first position in which said mobile part blocks the interior space between the curb and said static part and blocks the water collector system when in said second state for which the mobile platform is in the raised closing position, thereby closing the pool and providing an upper surface of the mobile part extends the walking surface of said static part, a second position lower than the first position in which the mobile part opens the water receiving gutter, allowing overflowing water to drop into the water receiving gutter, in said bottom position of the water collection system when in the first state in which the mobile platform is static, in the immersed bottom position, the mobile part blocking lateral openings of the gutter, water collected in the water receiving gutter being evacuated via bottom openings to the one or more buffer tanks, a third position higher than the first and second positions in which said mobile part is arranged above the level of the raised closing position the mobile platform, freeing the first openings of the water receiving gutter, forming the top position of the water collector system, said mobile part in said top position forming said anti-overflow peripheral barrier and said upper mouth system, the water propelled by the movements of the platform flowing through said circulation duct through first openings of the water receiving gutter.

12. The pool as claimed in claim 11, comprising at least one actuator with three stable positions respectively configured to control the mobile part in said first position, said second position and said third position.

13. The pool as claimed in claim 12, wherein said actuator with three stable positions comprises:

an actuator rod fastened to the mobile part and fastened to a cam mounted to pivot relative to the axis of the rod, said cam including cam lugs, a fixed cylinder including sloping notches, comprising first notches receiving the cam lugs in said blocking first position of said mobile part and second notches, at a lower level than the first notches, receiving the cam lugs in said second position of said mobile part, said first notches and the second notches being alternately distributed around the periphery of the fixed cylinder, a plunger coaxial with the fixed cylinder, received coaxially inside the fixed cylinder, configured to raise or to lower with no possibility of rotation about the axis of the fixed cylinder, having at an upper end a plurality of slopes, a pneumatic balloon received in the fixed cylinder in the uninflated state in the first position and in the second position of the mobile part and in the inflated state to actuate the plunger upon said mobile part raising into the third position, and in which said actuator is configured so that in each sequence of raising and lowering the plunger through the action of the pneumatic balloon the cam lugs then received in the first notches or alternatively said second notches are raised by the plunger, the slopes of the plunger bringing about after disengagement of the cam lugs from the first notches or alternatively the second notches the partial pivoting of the cam and the cam lugs, up until lowering of the plunger in which said partially pivoted lugs come to interengage with the second notches, or alternately said first notches, thereby achieving the passage from the second state to the first state of the water collector system, or vice-versa.

14. The pool as claimed in claim 4, wherein, said pool including the main tank, the one or more buffer tanks, the side walls, the circulation duct, the mobile platform, the actuator systems, the water collector system and the hollow structure is a self-supporting one-piece assembly.

15. The pool as claimed in claim 1, wherein the peripheral floor of the pool is substantially constructed at the height of the walking surface of said collector system in said bottom position of said collector system such that the pool is configured to be buried.

* * * * *